US006157120A

United States Patent [19]

Tseng et al.

[11] Patent Number: 6,157,120

[45] Date of Patent: Dec. 5, 2000

[54] SHADOW MASK FOR COLOR CRT HAVING DIFFERENT VERTICAL PITCH FOR OUTER PERIPHERY OF THE DISPLAY THAN INNER PORTION OF THE DISPLAY

[75] Inventors: Ching-Hsian Tseng, Yangmei; Hua Chung, I-Lan; Kuo-Cheng Chen, Chunghwa, all of Taiwan

[73] Assignee: Sanchong Picture Tubes, Ltd., Yangmei, Taiwan

[21] Appl. No.: 09/161,245

[22] Filed: Sep. 25, 1998

[51] Int. Cl.[7] ..... H01J 29/80

[52] U.S. Cl. ..... 313/402; 313/403; 313/408

[58] Field of Search ..... 313/402, 403, 313/408, 477 R

[56] References Cited

U.S. PATENT DOCUMENTS

| | | | |
|---|---|---|---|
| 3,735,190 | 5/1973 | Say | 315/13 |
| 4,623,818 | 11/1986 | Yamazaki | 313/408 |
| 5,072,150 | 12/1991 | Lee | 313/405 |
| 5,243,253 | 9/1993 | Marks et al. | 313/402 |
| 5,534,746 | 7/1996 | Marks et al. | 313/408 |
| 5,633,558 | 5/1997 | Watanabe et al. | 313/402 |
| 5,917,273 | 6/1999 | Watanabe et al. | 313/402 |

*Primary Examiner*—Michael H. Day
*Assistant Examiner*—Karabi Guharay
*Attorney, Agent, or Firm*—Emrich & Dithmar

[57] ABSTRACT

A color cathode ray tube (CRT) employs a color selection electrode in the form of a thin shadow mask located adjacent the CRT's display screen and having an array of electron beam passing apertures arranged in vertical columns and horizontal rows. To correct for electron beam landing tilt of three inline electron beams on the CRT's display screen arising from the spherical shape of the CRT's shadow mask and display screen, the shadow mask is provided with a two-step function defining the vertical pitch ($P_v$) of its apertures, or the vertical spacing between adjacent apertures not in the same vertical column. A first quadratic equation is used for defining the vertical pitch of the shadow mask's beam passing apertures covering a first generally flat inner area of the CRT's display screen from the center of the display screen out to where its radius of curvature substantially decreases adjacent its periphery. A second quadratic equation defines the vertical pitch of the shadow mask's beam passing apertures covering the more highly curved, peripheral portion of the display screen to correct for electron beam landing tilt and provide improved video image color purity tolerance. The two-step vari-bow shadow mask employing dual vari-Pv quadratic equations reduces electron beam landing tilt and increases color purity tolerance in areas adjacent to the margin of the effective viewing area of the display screen without reducing the screen's effective viewing area while maintaining a high degree of video image color purity.

6 Claims, 3 Drawing Sheets

SHADOW MASK FOR COLOR CRT HAVING DIFFERENT VERTICAL PITCH FOR OUTER PERIPHERY OF THE DISPLAY THAN INNER PORTION OF THE DISPLAY

FIELD OF THE INVENTION

This invention relates generally to color cathode ray tubes (CRTs) employing a color selection electrode in the form of an apertured shadow mask and is particularly directed to a shadow mask having an array of beam passing apertures arranged to reduce electron beam landing tilt on the CRT's display screen for improved video image color purity tolerance adjacent the periphery of the display screen.

BACKGROUND OF THE INVENTION

Color CRTs employ an electron gun arrangement that generates three independent electron beams, one for each of the three primary colors of red, green and blue. The electron beams are closely spaced within a common neck portion of the CRT's glass envelope, use a common magnetic deflection yoke for scanning, and are directed through a shadow mask having hundreds of thousands of small electron beam passing apertures. The shadow mask serves as a color selection electrode permitting only a designated electron beam to be incident upon a corresponding color producing phosphor element on the inner surface of the CRT's display screen. In many color CRTs, the three electron beams are arranged horizontally in an inline array.

The CRT's display screen and the shadow mask are arranged in closely spaced relation and are both curved in an axially symmetric fashion. The spherical shape of the display screen and shadow mask gives rise to distortion of the electron-spot triads, or the locations of incidence of the three electron beams on the inner surface of the display screen. The distortion is a foreshortening of the triads in the radial direction resulting in an effective rotation or tilt of the three electron beams particularly in the corners of the display screen. This is shown in FIG. 1 where there is illustrated a plan view of a CRT display screen 32. As shown in the corners of the display screen 32, and with particular reference to the upper right hand corner of the display screen, it can be seen that the triad of the three electron beams 34R (red), 34G (green), and 34B (blue) undergo an angular tilt arising from the geometric distortion of the curved shadow mask and display screen combination. This electron beam tilt reduces color purity tolerance of the video image presented on the display screen.

To correct for this geometric distortion, a conventional vari-bow shadow mask is adapted to accommodate a display panel having a single radius of curvature (1 R or 1.5 R). In the vari-bow shadow mask, the vertical pitch ($P_v$) or the vertical center-to-center spacing between adjacent shadow mask apertures not in the same vertical column, decreases gradually with increasing X in the horizontal direction. In other words, the vertical spacing between adjacent electron beam passing apertures decreases in proceeding from a vertical centerline of the mask toward one of its lateral edges. A quadratic equation is used for determining $P_v$ values as a function of the horizontal position X on the display screen. Referring to FIG. 2, there is shown a simplified plan view of a conventional color CRT shadow mask 36 showing for the sake of simplicity only a few of the large number of spaced electron beam passing apertures arranged in vertical columns and horizontal rows. Shadow mask 36 is defined by a horizontal X-axis and a vertical Y-axis (shown in the figure as dotted lines), each passing through the center of the shadow mask. Shadow mask apertures 35 in first and second vertically spaced horizontal rows 37 and 38 have a vertical center-to-center spacing of the vertical pitch $P_v$ which is defined by a quadratic equation over the entire surface of the shadow mask. This approach corrects for electron beam tilt for the inner portion of the CRT display screen where the radius of curvature is essential constant. However, with the introduction of high resolution CRTs having flatter display screens, the area outside of the area of fixed radius of curvature suffers from even greater electron beam tilt, particularly in the corners of the generally rectangular display screen. Thus, prior approaches employing a quadratic equation for defining shadow mask aperture vertical pitch have been unable to compensate for electron beam landing tilt over the entire visible area of the display screen, giving rise a reduction in video image color purity tolerance. In many cases, CRT manufacturers have elected to reduce the effective viewing area of the display screen in order to avoid these color purity problems. As a result, the actual viewing area of the CRT is smaller than originally designed. It is, of course, desirable to maximize the viewing area available on a given CRT display screen.

The present invention addresses the aforementioned limitations of the prior art by providing a shadow mask arrangement which compensates for electron beam tilt over both an inner, flatter portion of the CRT's display screen as well as over its outer, more highly curved periphery, and particularly in its corners. The inventive shadow mask arrangement increases video image color purity tolerance in those areas closest to the outer periphery of the display screen without reducing the effective viewing area of the screen.

OBJECTS AND SUMMARY OF THE INVENTION

Accordingly, it is an object of the present invention to provide improved video image color purity tolerance in a color CRT by compensating for electron beam land tilt on the CRT's display screen.

It is another object of the present invention to provide a video image in a color CRT which does not suffer from degradation of video image color purity tolerance adjacent its periphery without reducing the effective viewing area of the CRT's display screen.

Yet another object of the present invention is to compensate for a change in curvature in a CRT display screen adjacent its peripheral edge by providing a corresponding change in the vertical spacing between adjacent electron beam passing apertures in the CRT's shadow mask so as to maintain alignment between the video image-producing phosphor deposits on the display screen and the shadow mask apertures.

This invention contemplates a color CRT for displaying a color video image, the CRT comprising an electron gun for providing a plurality of electron beams, wherein the electron beams are arranged in an inline array; a generally rectangular display screen having a generally spherical curvature and a plurality of discrete phosphor deposits on an inner surface thereof, wherein each phosphor deposit emits red, green or blue light when an associated electron beam is incident thereon, the display screen having a first inner area defined by a first radius of curvature $R_1$ from a center of the display screen to a distance D from the center and a second outer area defined by a second radius of curvature $R_2$ from D to a peripheral edge of the display screen, where $R_1 >> R_2$; and a generally rectangular shadow mask disposed in closely spaced relation to the inner surface of the display screen and having a generally spherical curvature and a plurality of spaced apertures, wherein each electron beam is directed through selected ones of the apertures and is incident upon selected ones of the phosphor deposits on the display screen for providing one of the primary colors of red, green or blue of the video image, wherein the apertures are arranged in vertical columns and horizontal rows, with apertures in one row being in different columns than are apertures in adjacent rows and with the vertical spacing between adjacent apertures within a column being the vertical pitch of the apertures, wherein shadow mask apertures through which electron beams are directed onto the first inner area of the display screen have a first vertical pitch $P_v1$ and shadow mask apertures through which electron beams are directed onto the second outer area of the display screen have a second vertical pitch $P_v2$, where $P_v1>P_v2$.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 3:
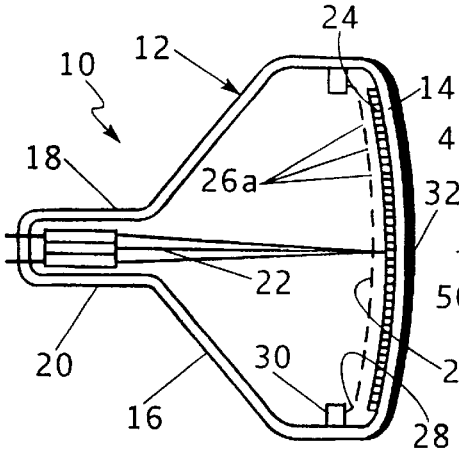
FIG. 3 is a lateral sectional view of a conventional color CRT in which the shadow mask of the present invention is intended for use.

Referring to FIG. 3, there is shown a lateral sectional view of a conventional color CRT 10 in which the shadow mask of the present invention is intended for use. The CRT 10 includes a sealed glass envelope 12 having a forward faceplate or display screen 14, an aft neck portion 18, and an intermediate funnel portion 16. Disposed on the inner surface of glass faceplate 14 is a phosphor screen 24 which includes a plurality of discrete phosphor deposits, or elements, which emit light when an electron beam is incident thereon to produce a video image on the faceplate. The color CRT 10 includes three electron beams 22 directed onto and focussed upon the CRT's glass faceplate 14. Disposed in the neck portion 18 of the CRT's glass envelope 12 are a plurality of electron guns 20 typically arranged in an inline array for directing the electron beams 22 onto the phosphor screen 24. Electron beams 22 are deflected vertically and horizontally in unison across the phosphor screen 24 by a magnetic deflection yoke which is not shown in the figure for simplicity. Disposed in a spaced manner from phosphor screen 24 is a shadow mask 26 having a plurality of spaced electron beam passing apertures 26*a* and a skirt portion 28 around the periphery thereof. The shadow mask skirt portion 28 is securely attached to a shadow mask mounting fixture 30 around the periphery of the shadow mask. The shadow mask mounting fixture 30 is attached to an inner surface of the CRT's glass envelope 12 and may include conventional attachment and positioning structures such as a mask attachment frame and mounting springs which are described below. The shadow mask mounting fixture 30 is attached to the inner surface of the CRT's glass envelope 12 by conventional means such as weldments or a glass-based frit and the shadow mask 26 is attached to the mounting fixture also by conventional means such described below.

Figure 4:
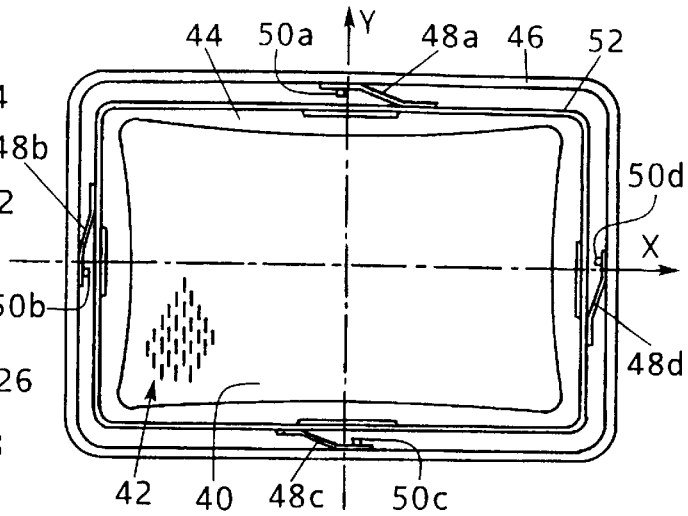
FIG. 4 is a plan view of a conventional shadow mask showing details of the manner in which the shadow mask is mounted within the CRT's glass envelope.
Figure 1:
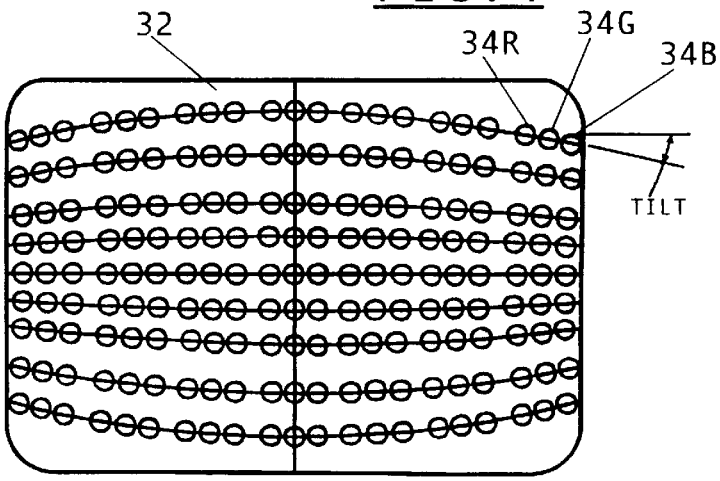
FIG. 1 (PRIOR ART)
FIG. 1 is a plan view of a CRT display screen showing the tilt of three electron beams incident on the display screen which is characteristic of prior color CRTs.
Figure 2:
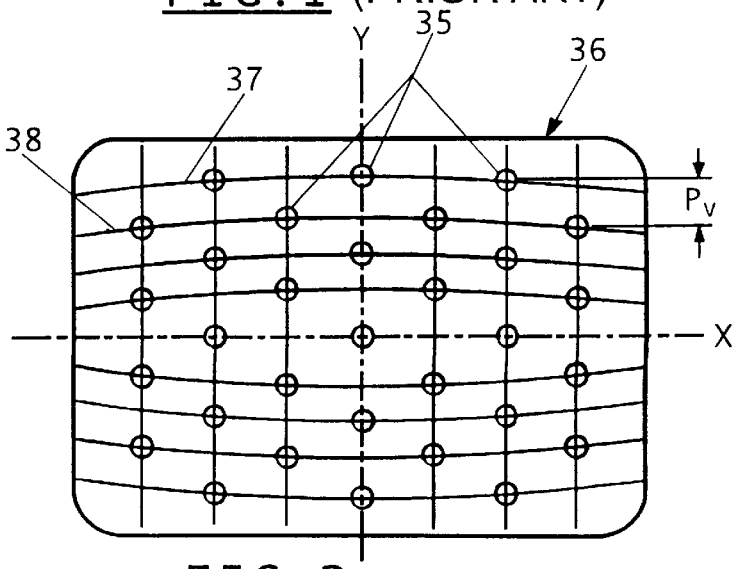
FIG. 2 (PRIOR ART)
FIG. 2 is a plan view of a conventional color CRT shadow mask showing the vertical pitch between adjacent electron beam passing apertures in the mask as a function of horizontal position from the mask's vertical centerline as determined by a single quadratic equation.

Referring to FIG. 4, there is shown a plan view of a conventional shadow mask 40 and details of the manner in which the shadow mask is mounted within the CRT's glass envelope 46. The shadow mask 40 is in the form of a thin metal foil and includes a plurality of spaced beam passing apertures 42 (only a portion of which are shown in the figure for simplicity). The beam passing apertures 42 are located in an inner portion of the shadow mask 40 which is maintained under tension and is in closely spaced relation from the CRT's glass faceplate. Disposed about the apertured inner portion of the shadow mask 40 is a shadow mask skirt 44. Attached to and disposed about the shadow mask skirt 44 is a shadow mask frame 52 having a generally rectangular shape. Disposed about the shadow mask frame 52 in a spaced manner are four resilient metal holders, or springs, 48*a*, 48*b*, 48*c* and 48*d*. The four resilient metal holders 48*a*, 48*b*, 48*c* and 48*d* are securely attached to the shadow mask frame 52 by conventional means such as weldments. Each resilient metal holder 48*a*, 48*b*, 48*c* and 48*d* includes an aperture for receiving a respective mounting stud 50*a*, 50*b*, 50*c* and 50*d*. Each of the mounting studs 50*a*, 50*b*, 50*c* and 50*d* is attached to a respective inner flat surface of the CRT's glass envelope 46 using conventional means such as a glass frit. The mounting studs 50*a*, 50*b*, 50*c* and 50*d* inserted through respective apertures in the resilient metal holders 48*a*, 48*b*, 48*c* and 48*d* securely maintain the shadow mask 40 in fixed position within the CRT's glass envelope 46 and in spaced relation from the CRT's glass faceplate, or display panel.

Figure 5:
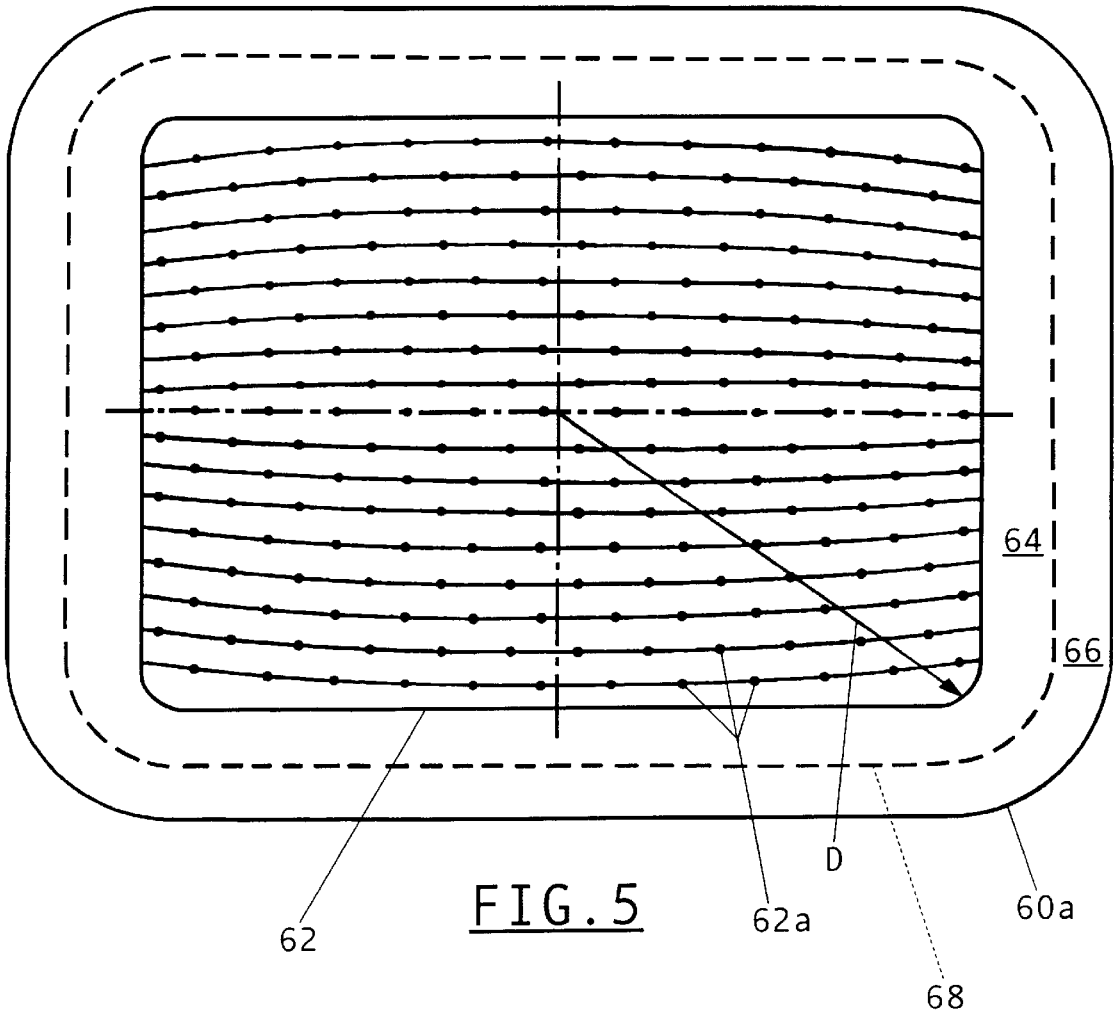
FIG. 5 is a plan view of the CRT display screen and shadow mask combination showing inner and outer portions of the display screen, each having a different vertical pitch of the electron beam passing apertures in the shadow mask in accordance with the present invention.

Referring to FIG. 5, there is shown a plan view of a CRT shadow mask 62 and display screen 60 combination showing a first inner area 64 and a second outer area 66 of the display screen in accordance with the present invention. The shadow mask 62 is provided with a plurality of spaced beam passing apertures 62*a*. The first inner area 64 of display screen 60 is characterized as having a first radius of curvature, while the second outer area 66*a* is characterized as having a second radius of curvature, where the first radius of curvature is much larger than the second radius of curvature. Thus, the first inner area 64 is much flatter, or planar, than the second outer area 66 of the display screen 60. There is a transition zone between the first inner and second outer areas 64,66 shown as a connecting line 68 in dotted line form and represented as the distance D from the screen's center. Because the screen is rectangular, D will vary in proceeding around the periphery of the screen. The transition zone marks the separation between the first inner area 64 and the second outer area 66 of the display screen 60 characterized by a change in the display screen's radius of curvature. A first quadratic equation defines the vertical pitch ($P_v$) between adjacent apertures in the same vertical column in the shadow mask 62 through which electron beams incident upon the shadow mask's first inner area 64 pass. The first quadratic equation defining the vertical pitch between the apertures in the shadow mask 62 through which electron beams are directed onto the first inner area 64 of display screen 60 is:

$$P_v1=0.135\ (1-1.21\times10^{-6}X^2) \quad (1)$$

where X is the distance on the shadow mask along the X-axis from the mask's Y-axis in millimeters. The vertical pitch of the beam passing apertures in the shadow mask 62 through which electron beams incident upon the shadow mask's second outer area 66 pass is determined by a second quadratic equation which is:

$$P_v2=0.132\ (1.246-13.397\times10^{-6}X^2) \quad (2)$$

Equations 1 and 2 and the following discussion are directed to a 15" display screen. For a typical 15" display screen, the first inner area of the screen has a large radius of curvature typically on the order of 900R. The second outer area of the display screen has a much smaller radius of curvature, typically on the order of 7R. A 15" display screen should have an effective viewing area of 14". Using a conventional vari-bow shadow mask design where the vertical pitch is defined by a single quadratic equation over the entire mask, can compensate for electron beam landing tilt only up to 13.89" from the center of the display screen. This is, by definition, the transition zone, or the connecting line, between the display screen's inner planar and outer curved areas as described above.

Quadratic equation number 1 above is used to compensate for electron beam landing tilt from X=0 to 135.49 mm over the half range of the display screen, which is the effective display area of the shadow mask in the horizontal, or X, direction. If the viewing area is expanded to 14.07", the effective horizontal area of the mask will be increased from 135.49 to 137.36 mm, and the second quadratic equation above is used over the latter range. Thus, the change in vertical pitch using the second quadratic equation above is much greater than that over any portion of the first inner area of the display screen as determined by the first quadratic equation above. With the two-step vari-bow shadow mask of the present invention, the effective or useable area of the screen for presenting a video image is increased from 13.89" to 14.07" without a degradation in video image color purity. It should be noted that while Equations 1 and 2 relate to a 15" display screen with a given curvature, these equations are equally applicable to virtually any display screen having an inner surface area with a large radius of curvature and a peripheral surface area with a much smaller radius of curvature. The constants in these equations can be determined by measuring the dimensions of the different surface areas which could easily be accomplished by one skilled in the relevant arts.

Figure 6:
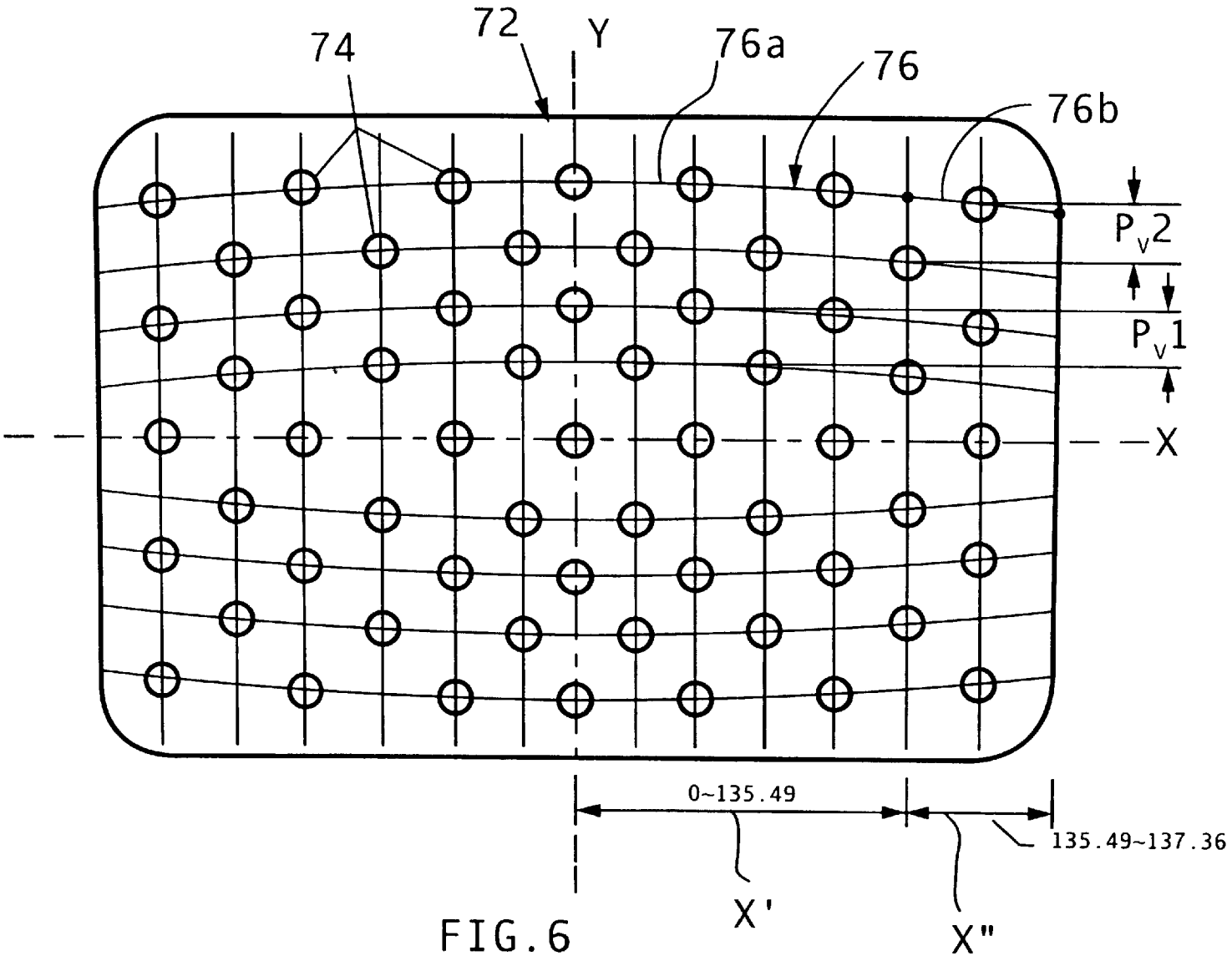
FIG. 6 is a simplified plan view of a shadow mask in accordance with the present invention having a large number of electron beam passing apertures characterized as having a first vertical pitch between adjacent beam passing apertures in the same vertical column on an inner portion of the shadow mask and a second, smaller vertical pitch between adjacent apertures in an outer, peripheral portion of the shadow mask.

Referring to FIG. 6, there is shown a simplified plan view of a shadow mask 72 in accordance with the present invention having a large number of electron beam passing apertures 74 characterized as having a first vertical pitch between adjacent beam passing apertures in the same vertical column on an inner portion of the shadow mask and a second, smaller vertical pitch between adjacent apertures in an outer, peripheral portion of the shadow mask. The shadow mask apertures 74 are shown as a series of circles in the shadow mask 72 arranged in vertical columns and generally horizontal rows. Each of the horizontal rows of beam passing apertures is shown as a generally horizontal, curved line drawn between the apertures in the same row. The top row of beam passing apertures is thus shown as line 76, and includes an inner portion 76*a* extending outward from the mask's Y-axis toward the left and right lateral edges of the shadow mask 72. For the case of a typical 15" display screen, the first inner portion of the shadow mask 72 extends outwardly toward the lateral edges a distance on the order of 135.49 mm from the mask's Y-axis. A second outer portion of the shadow mask 72 extends from 135.49 mm from the Y-axis out to the lateral edge of the shadow mask, which is on the order of 137.36 mm. The first inner and second outer areas of the shadow mask 72 differ in the vertical pitch ($P_v$) between adjacent beam passing apertures in the same vertical column. In the first inner portion of the shadow mask 72, or from the Y-axis out to 135.49 mm, the vertical pitch is shown as $P_v1$. Similarly, the vertical pitch in the second outer portion of the shadow mask 72, or from 135.49 mm out to a lateral edge of the shadow mask which is on the order of 137.36 mm from the Y-axis, is shown as $P_v2$. In accordance with the present invention, $P_v1>P_v2$, where $P_v1$ is defined by a first quadratic equation and $P_v2$ is defined by a second quadratic equation. The first quadratic equation is used for defining the vertical pitch of the shadow mask's beam passing apertures covering a first generally flat inner area of the CRT's display screen from the center of the display screen out to where the screen's radius of curvature substantially decreases adjacent this lateral periphery. The second quadratic equation defines the vertical pitch of the shadow mask's beam passing apertures covering the more highly curved, peripheral portion of the display screen adjacent its lateral edges to correct for electron beam landing tilt and provide improved video image color purity tolerance.

Referring to Table I, there is shown a comparison of the vertical pitch values in a prior art shadow mask employing a single quadratic equation with the vertical pitch values in a shadow mask employing the dual quadratic equation approach of the present invention.

TABLE I

| X (mm) | 0 | 135.49 | 137.36 |
|---|---|---|---|
| Pv (single vari-bow) | 0.135 | 0.1320 | 0.1319 |
| Pv (two-slep vari-bow) | 0.135 | 0.1320 | 0.1311 |
| Viewing area | — | 13.89" | 14.07" |

Table I shows the values of the vertical pitch from the Y-axis (where X=0), at 135.49 mm and 137.36 mm from the Y-axis. The latter number represents the lateral edge of a 15" display screen. From the table, it can be seen that the vertical pitch is the same for the inner portions of the two shadow masks. However, adjacent the lateral edges of the shadow mask, the vertical pitch of the beam passing apertures in the inventive shadow mask is less than that in the prior art shadow mask in order to reduce electron beam tilt particularly at the corners of the CRT's display screen for improved color purity tolerance of the video image presented on the display screen.

There has thus been shown an arrangement in a color CRT for correcting for electron beam tilt caused by the spherical shape of the CRT's shadow mask and display screen. The display screen is defined in terms of a generally flat first inner area having a large radius of curvature and the second outer peripheral area having a much smaller radius of curvature. The vertical pitch, or vertical spacing between adjacent electron beam passing apertures in the same vertical column in the shadow mask, is varied in proceeding from the center of the mask to the outer lateral edges of the mask. A first quadratic equation defines the vertical pitch of the shadow mask apertures which direct electron beams onto the display screen's first inner area, and a second quadratic equation defines the vertical pitch between shadow mask apertures which direct electron beams onto the screen's second outer peripheral area. By dividing the display screen and shadow mask into two separate areas determined by the radius of curvature of the display screen, the vertical pitch of the shadow mask apertures is varied so as to compensate for electron beam tilt on the display screen and provide a high degree of color purity tolerance without reducing the effective viewing area of the display screen.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A color cathode ray tube (CRT) for displaying a color video image, said CRT comprising:

an electron gun for providing a plurality of electron beams, wherein said electron beams are arranged in an inline array;

a generally rectangular display screen having a generally spherical curvature and a plurality of discrete phosphor deposits on an inner surface thereof, wherein each phosphor deposit emits red, green or blue light when an associated electron beam is incident thereon, said display screen having a first inner area defined by a first radius of curvature $R_1$ from a center of the display screen to a distance D from said center and a second outer area defined by a second radius of curvature $R_2$ from D to a peripheral edge of said display screen, where $R_1 >> R_2$; and a generally rectangular shadow mask disposed in closely spaced relation to the inner surface of said display screen and having a generally spherical curvature and a plurality of spaced apertures, wherein each electron beam is directed through selected ones of said apertures and is incident upon selected ones of the phosphor deposits on said display screen for providing one of the primary colors of red, green or blue of the video image, wherein said apertures are arranged in vertical columns and horizontal rows, with apertures in one row being in different columns than are apertures in adjacent rows and with the vertical spacing between adjacent apertures not within the same column being the vertical pitch of the apertures, wherein shadow mask apertures through which electron beams are directed onto the first inner area of the display screen have a first vertical pitch $P_v1$ and shadow mask apertures through which electron beams are directed onto the second outer area of the display screen have a second vertical pitch $P_v2$, where $P_v1 > P_v2$, wherein the first vertical pitch $P_v1$ and the second vertical pitch $P_v2$ are each respective quadratic functions of a distance X from a vertical centerline of said display screen.

2. The CRT of claim 1 wherein said display screen has a diagonal dimension of 15", said first and second radii of curvature $R_1$, $R_2$ are respectively 900R and 7R, and wherein said first vertical pitch $P_v1$ and said second vertical pitch $P_v2$ are respectively given by the following expressions:

$$P_v1=0.135\ (1-1.21\times10^{-6}X^2)$$

$$P_v2=0.132\ (1.246-13.397\times10^{-6}X^2).$$

3. A shadow mask for use with a generally rectangular display screen in a color cathode ray tube (CRT), said display screen having electron beam sensitive phosphor deposits thereon for providing a video image, wherein said display screen includes an inner surface area having a first radius of curvature $R_1$ and an outer, peripheral surface area having a second radius of curvature $R_2$, where $R_1 >> R_2$, said shadow mask comprising:

a thin metal foil generally rectangular in shape and having a generally spherical curvature, wherein said thin metal foil is disposed in closely spaced relation to the display screen and includes first and second opposed lateral edges; and a plurality of spaced apertures in said metal foil arranged in vertical columns and horizontal rows with apertures in one row being in different columns than are apertures in adjacent rows and with the vertical spacing between adjacent apertures not within the same column being the vertical pitch of the apertures, wherein each electron beam is directed through selected ones of said apertures and is incident upon selected ones of said phosphor deposits on the display screen to provide one of the primary colors of red, green or blue of the video image, wherein shadow mask apertures through which electron beams are directed onto the inner surface area of the display screen having a first vertical pitch $P_v1$ and shadow mask apertures through which electron beams are directed onto the outer, peripheral surface area of the display screen have a second vertical pitch $P_v2$, where $P_v1 > P_v2$, wherein the first vertical pitch $P_v1$ and the second vertical pitch $P_v2$ are each respective quadratic functions of a distance X from a vertical centerline of said display screen.

4. The shadow mask of claim 3 wherein said display screen has a diagonal dimension of 15", said first and second radii of curvature $R_1$, $R_2$ are respectively 900R and 7R, and wherein said first vertical pitch $P_v1$ and said second vertical pitch $P_v2$ are respectively given by the following expressions:

$$P_v1=0.135\ (1-1.21\times10^{-6}X^2)$$

$$P_v2=0.132\ (1.246-13.397\times10^{-6}X^2).$$

5. A shadow mask for use in a color cathode ray tube (CRT), said shadow mask comprising:

a thin metal foil having opposed lateral edges and upper and lower edges defining a generally rectangular shape, said thin metal foil further having a first inner area and a second lateral peripheral area; and means defining a plurality of spaced electron beam passing apertures in said thin metal foil, wherein said apertures are arranged in vertical columns and horizontal rows with vertical spacing between adjacent apertures not within the same column being a vertical pitch of the apertures, wherein said apertures have a first vertical pitch $P_v1$ in said first inner area and a second vertical pitch $P_v2$ in said second lateral peripheral area, where $P_v1>P_v2$, wherein the first vertical pitch $P_v1$ and the second vertical pitch $P_v2$ are each respective quadratic functions of a distance X from a vertical centerline of said display screen.

6. The shadow mask of claim 5 wherein said first vertical pitch $P_v1$ and said second vertical pitch $P_v2$ are respectively given by the following expressions:

$$P_v1=K_1\ (1-1.21\times10^{-6}X^2)$$

$$P_v2=K_2\ (1.246-13.397\times10^{-6}X^2)$$

$K_1$, $K_2$=constants.

* * * * *

UNITED STATES PATENT AND TRADEMARK OFFICE

CERTIFICATE OF CORRECTION

PATENT NO. : 6,157,120
DATED : December 5, 2000
INVENTOR(S) : Tseng et al.

It is certified that error appears in the above-identified patent and that said Letters Patent is hereby corrected as shown below:

[75] Inventors: after "Kuo-Cheng Chen," delete "Chunghwa" insert "Sanchong"

[73] Assignee: delete "Sanchong" insert "Chunghwa"

Signed and Sealed this

First Day of May, 2001

*Attest:*

Nicholas P. Godici

NICHOLAS P. GODICI

*Attesting Officer*

*Acting Director of the United States Patent and Trademark Office*